US009037018B1

(12) United States Patent
Cousoulis et al.

(10) Patent No.: US 9,037,018 B1
(45) Date of Patent: May 19, 2015

(54) CHARGE SLOPE DERIVATION CONTROL OF TONER CONCENTRATION

(71) Applicant: Lexmark International, Inc., Lexington, KY (US)

(72) Inventors: Marc Cousoulis, Lexington, KY (US); Courtney Harrison Soale, Lexington, KY (US)

(73) Assignee: Lexmark International, Inc.KY (US)

( * ) Notice: Subject to any disclaimer, the term of this patent is extended or adjusted under 35 U.S.C. 154(b) by 0 days.

(21) Appl. No.: 14/179,838

(22) Filed: Feb. 13, 2014

(51) Int. Cl.
*G03G 15/09* (2006.01)
*G03G 15/00* (2006.01)

(52) U.S. Cl.
CPC ..... *G03G 15/0907* (2013.01); *G03G 15/80* (2013.01)

(58) Field of Classification Search
None
See application file for complete search history.

(56) References Cited

U.S. PATENT DOCUMENTS

| | | | | |
|---|---|---|---|---|
| 5,155,530 | A * | 10/1992 | Larson et al. | 399/55 |
| 5,937,227 | A | 8/1999 | Wong et al. | |
| 6,173,134 | B1 | 1/2001 | Nishimura et al. | |
| 2005/0063715 | A1 * | 3/2005 | Suzuki et al. | 399/27 |

* cited by examiner

*Primary Examiner* — Clayton E LaBalle
*Assistant Examiner* — Jas Sanghera

(57) ABSTRACT

A method of controlling toner concentration in an image forming device by determining a charge per unit mass of toner in a mixture of toner and carrier and adding toner to the mixture if the charge per unit mass of the toner is higher than a predetermined threshold. Other methods and devices are disclosed.

7 Claims, 5 Drawing Sheets

CHARGE SLOPE DERIVATION CONTROL OF TONER CONCENTRATION

CROSS REFERENCES TO RELATED APPLICATIONS

None

BACKGROUND

1. Field of the Disclosure

The present disclosure relates generally to image forming devices and more particularly to methods and devices to control toner concentration in an image forming device.

2. Description of the Related Art

Dual component development (DCD) electrophotography printing systems utilize a developer mixture of toner and magnetic carrier in the printing process. Multiple strategies have been employed to control the toner concentration in this mixture with varying levels of success. One method is to utilize a toner concentration sensor that measures the magnetic permeability of the developer mix. As the toner concentration decreases, the magnetic permeability of the mixture increases, which changes the sensor output voltage. A control system adds toner to the mixture to maintain the sensor output voltage at a given set point. An alternative method for controlling toner concentration is to count the number of individual pixels imaged, computing the toner volume consumed, and replenishing toner in the mixture based on this computation.

The traditional methods of controlling toner concentration attempt to maintain a specific ratio of toner to carrier in the developer mixture. However, as the mixture ages, due to prolonged rubbing of toner and carrier, the toner charge for a given toner concentration will change. Toner charge impacts development efficiency and, thus, impacts print quality. Accordingly, a method to minimize the impact of this aging is desired.

SUMMARY

A method of operating an image forming device that includes a mixture of toner and carrier according to one example embodiment includes developing a first toner image at a first development bias voltage, determining a first mass per unit area of the first toner image, developing a second toner image at a second development bias voltage, the second development bias voltage is not equal to the first development bias voltage, determining a second mass per unit area of the second toner image, and adjusting a ratio of toner to carrier in the mixture as a function of the first development bias voltage, the second development bias voltage, the first mass per unit area, and the second mass per unit area.

A method of controlling toner concentration in an image forming device that includes a mixture of toner and carrier according to another example embodiment includes determining a charge per unit mass of the toner in the mixture and adding toner to the mixture if the charge per unit mass of the toner is higher than a predetermined threshold.

An image forming device according to one example embodiment includes a photoconductor, a magnetic roller, a power supply, a mixture of toner and carrier to be transported by the magnetic roller such that the toner is developed onto the photoconductor, a toner feed mechanism configured to add toner to the mixture, an optical sensor configured to measure a mass per unit area of toner developed on the photoconductor, and a controller. The power supply is coupled to the photoconductor and to the magnetic roller, and is configured to drive a development bias voltage between the photoconductor and the magnetic roller. The controller is coupled to the power supply, the toner feed mechanism, and the optical sensor. The controller is configured to develop a plurality of toner images at different development bias voltages, measure the mass per unit area of the images, compute the slope of a linear equation relating change in development bias voltage to change in mass per unit area, and add toner to the mixture if the slope deviates from a predetermined operating point.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
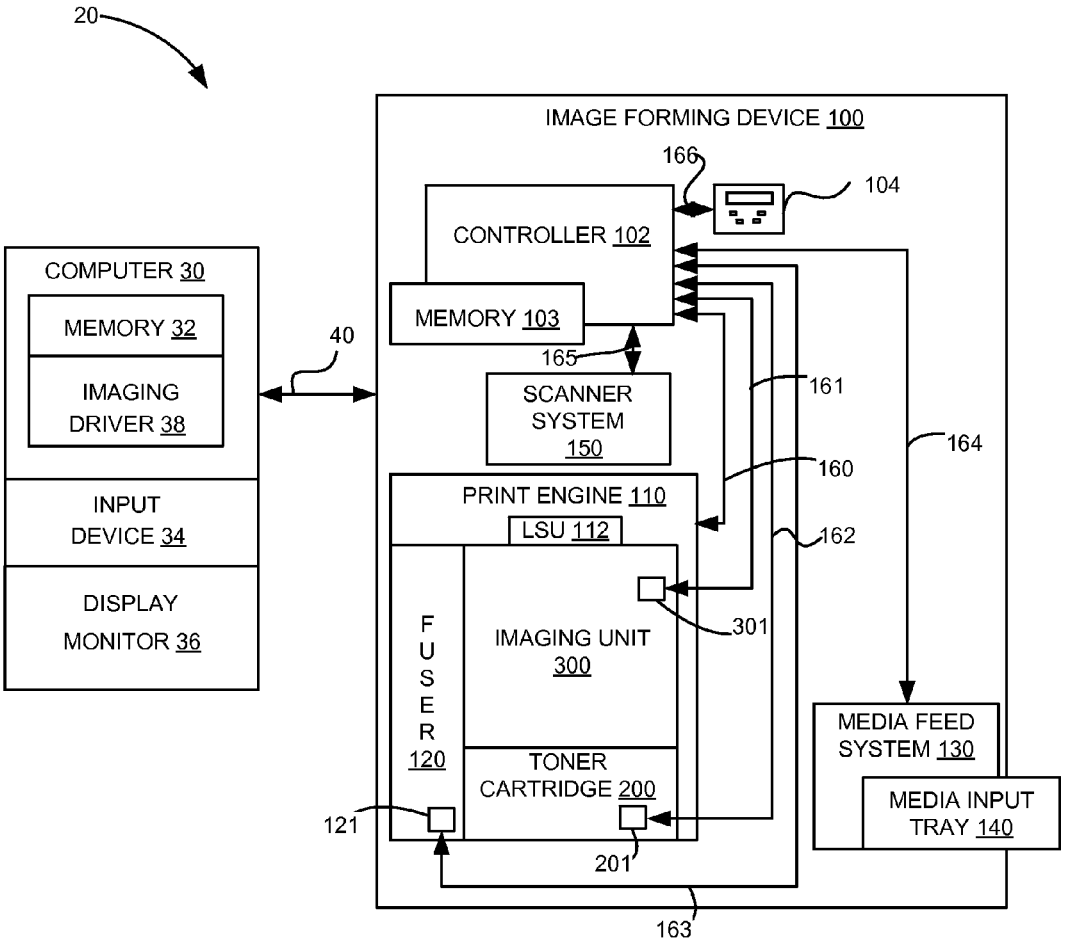
FIGS. 1 and 2 are schematic diagrams of an image forming device according to an example embodiment.

Referring now to the drawings and more particularly to FIG. 1, there is shown a block diagram depiction of an imaging system 20 according to one example embodiment. imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image for device 100 so as to accommodate printing and/or scanning functionality when operating in the standalone mode.

Figure 2:
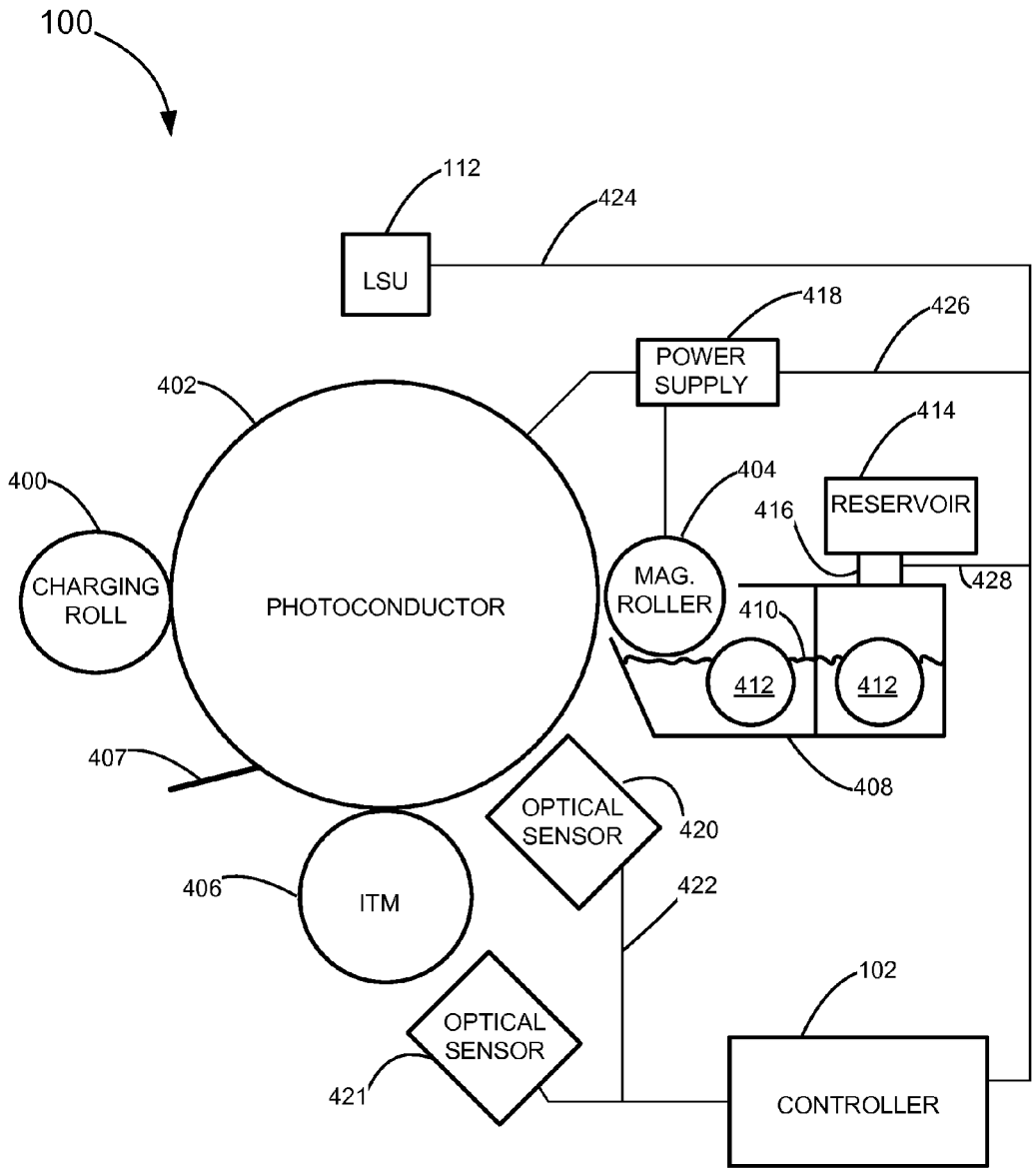

FIG. 2 illustrates a schematic view of a portion of image forming device 100. The electrophotographic printing process is well known in the art and, therefore, is briefly described herein. Image forming device utilizes what is commonly referred to a dual component development (DCD) system. During a print operation, a charging roll 400 charges the surface of a photoconductor 402 to a specified voltage such as, for example, −1000 volts. A laser beam from LSU 112 is then directed to the surface of photoconductor 402 and selectively discharges those areas it contacts to form a latent image. In one embodiment, areas on photoconductor 402 illuminated by the laser beam are discharged to approximately −300 volts. A magnetic roller 404 then transfers toner to the areas discharged on photoconductor 402 to form a toner image on photoconductor 402. The toner is attracted to the areas of the surface of photoconductor 402 discharged by the laser beam from LSU 112.

An intermediate transfer mechanism (ITM) 406 is disposed adjacent to the photoconductor 402. In one embodiment, a positive voltage field attracts the toner image from photoconductor 402 to the surface of the moving ITM 406, ITM 406 rotates and collects the one or more toner images from photoconductor 402 and then conveys the toner images to a media sheet (not shown) for fusing in a fuser (not shown). A cleaning blade 407 removes any residual toner from the photoconductor 402. Note that, in some embodiments, the ITM 406 may be absent and, thus, the image may be transferred directly from the photoconductor 402 to a media sheet.

Magnetic roller 404 transfers toner by picking up carrier from a sump 408 via magnetic fields. The carrier may be, for example, magnetic carrier beads coated with a polymetric film to provide triboelectric properties to attract toner to the carrier beads. Alternatively, the carrier may be, for example, magnetic carrier beads that lack a coating. Sump 408 contains a mixture 410 of carrier and toner. Auger(s) 412 circulate the mixture 410 in a loop around the sump 408, which rubs the carrier and toner together. This causes the toner to develop a charge due to the different triboelectrical values of the carrier and the toner. The charged toner clings to the carrier and, thus, is transported with the carrier by magnetic roller 404. The toner is transferred from magnetic roller 404 to the areas discharged by LSU 112 on photoconductor 402 and the carrier is returned to the mixture 410.

Toner in the mixture 410 is replenished from a toner reservoir 414 via toner feed mechanism 416. Reservoir 414 may be, for example, a detachable bottle holding the main toner supply of image forming device 100. Toner feed mechanism may be, for example, a motor-driven auger. Note that a multicolor printer may contain separate imaging stations for each color. For example, a four color printer may contain four imaging stations.

A power supply 418 is electrically connected to a conductive back plane of photoconductor 402 and is also connected to magnetic roller 404. Power supply 418 drives a voltage between the conductive back plane of photoconductor 402 and the surface of magnetic roller 404. This voltage is referred to as the development bias (Vb). The conductive backplane of photoconductor 402 may be grounded.

An optical sensor 420 is located between the magnetic roller 404 and the ITM 406. Optical sensor 420 measures the reflectivity of the toner image to determine the toner density and thus determine the mass per unit area developed to the photoconductor. The toner images measured by the optical sensor may be, for example, rectangular toner patches with uniform image density within a toner patch. Optical sensor 420 is positioned to measure toner located on the photoconductor. An alternate optical sensor 421 may be positioned to measure toner located on the ITM. The alternate optical sensor 421 views the ITM 406 instead of the photoconductor and thus measures toner images located on the ITM 406.

Controller 102 communicates with optical sensor 420 via communications link 422. Controller 102 also communicates with LSU 112, power supply 418, and toner feed mechanism 416 via communications link 424, communications link 426, and communications link 428 respectively.

For a given toner image, the amount of toner developed to the surface of the photoconductor is given by:

$$M=(1/Q)*Vb*K+B \quad \text{(equation 1)}$$

M is the mass per unit area of toner developed to the photoconductor, Q is the charge per unit mass of the toner particle, Vb is the development bias voltage between magnetic roller 404 and photoconductor 402, and K and B represent a set of variables dictated by the rest of the development system. Units may be, for example, grams per centimeter squared for NI, coulombs per gram for Q, volts for Vb, farads per squared centimeter for K, and grams per centimeter squared B. Vb may be measured at the output of power supply 418 during printing. M may be measured using optical sensor 420 during printing. K may be determined experimentally by measuring M, Q, and Vb in a laboratory. K is effectively constant for a given imaging unit.

Figure 3:
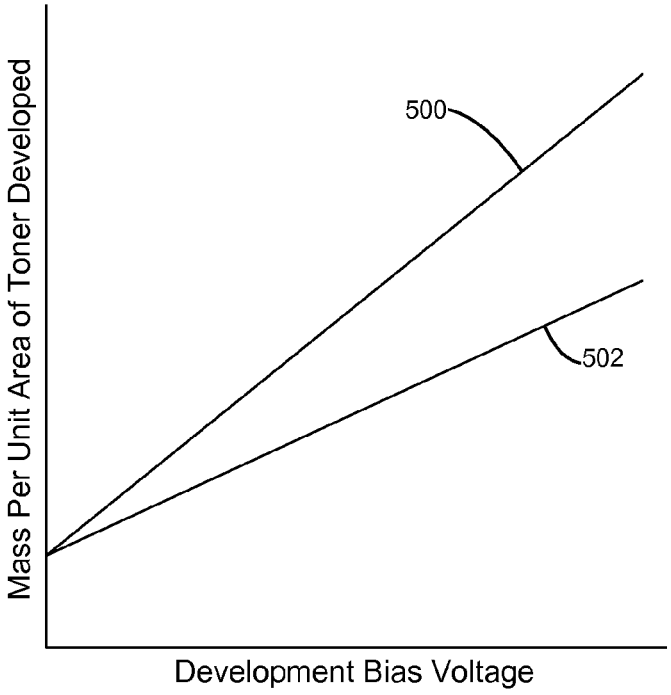
FIG. 3 is a graph of an equation relating mass of toner developed to a photoconductor to development bias voltage showing different charges.

FIG. 3 shows a graph of mass per unit area versus development bias voltage according to equation 1 at two different charges. Note that, for a given K, the slope of the equation is related to the charge per unit mass of the toner particle (Q). Line 500 is at a lower charge than line 502. Charge per unit mass of the toner particle increases as the weight concentration of toner to the carrier in the mixture 410 decreases. As a result, excessively high Q indicates a need to add more toner to the mixture 410. Excessively high Q creates print quality defects due to reduced M and is undesirable.

Figure 4:
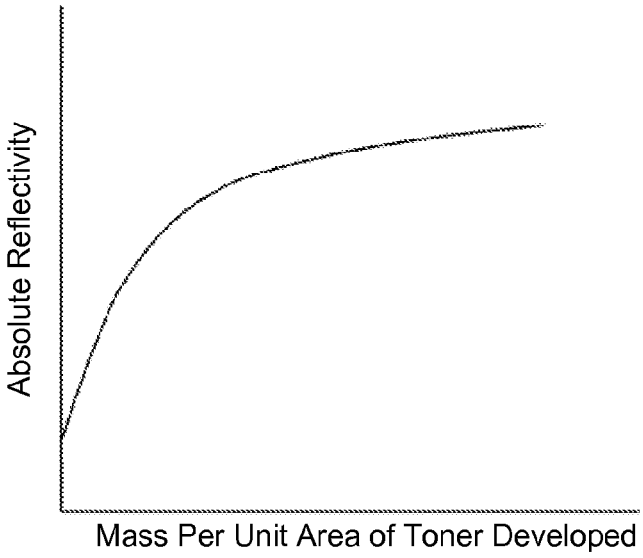
FIG. 4 is a graph relating absolute reflectivity to mass of toner developed to a photoconductor.

FIG. 4 shows a graph of absolute reflectivity of a given toner image on photoconductor 402 vs. the mass per unit area of toner developed to the photoconductor for a given optical sensor. Thus, by measuring absolute reflectivity, the optical sensor may measure mass per unit area of toner.

Figure 5:
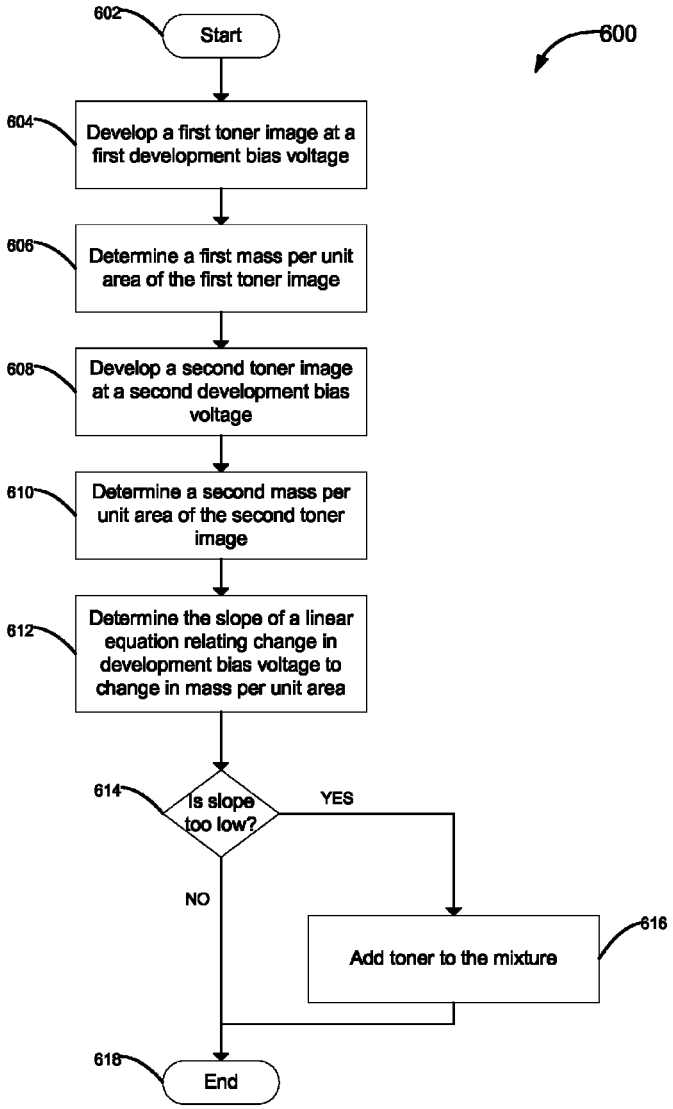
FIG. 5 is a flowchart of a method of operating an image forming device according to one example embodiment.

FIG. 5 shows an example embodiment of a method 600 of operating an image forming device according to one embodiment. Method 600 improves print quality by adjusting the ratio of toner to carrier in a mixture in a print engine. This ratio impacts the charge per unit mass of the toner which impacts the mass per unit area of toner images.

At block 604, controller 102 determines a first toner image at a first development bias voltage. For example, the first development bias voltage may be 100V. At block 606, controller 102 determines a first mass per unit area of the first toner image. For example, an optical sensor may measure the reflectivity of the toner image to measure the mass per unit area.

At block 608, controller 102 develops a second toner image at a second development bias voltage which is not equal to the first development bias voltage. For example, the second development bias voltage may be 200V. In this example, the LSU discharges the same pattern onto the photoconductor for both toner images. However, the toner images will have different mass per unit area since they were created with different development bias voltages. Since, in this example, the second development bias voltage is greater than the first development bias voltage, the second toner image will have a greater mass per unit area. At block 610, controller 102 determines a second mass per unit area of the second toner image.

At block 612, controller 102 determines the slope of a linear equation relating change in development bias voltage, between the first development bias voltage and the second development bias voltage, to change in mass per unit area, between the first mass per unit area and the second mass per unit area. For example, controller 102 may determine the slope of equation 1 which was described previously.

At block 614, a determination is made whether the slope of the linear equation exceeds a threshold, e.g., is too low. The slope of equation 1 is proportional to the charge per unit mass of the toner in the mixture. If the slope is too low, at block 616 controller 102 adjusts the ratio of toner to carrier in the mixture by adding toner to the mixture. If the slope is too low, it indicates that the charge per unit mass is too high. Adding toner to the mix will reduce the charge per unit mass of the toner in the mixture.

The method 600 maintains a constant toner charge in the mixture. This compensates for decreased development efficiency due to mixture aging and, thus, improves print quality.

Note that the steps of method 600 may be performed in alternative orders. For example, block 604 and block 608 may be performed before block 606 and block 610. In this example, the first toner image and the second toner image are developed and then the optical sensor measures the mass per unit area of the two images.

Figure 6:
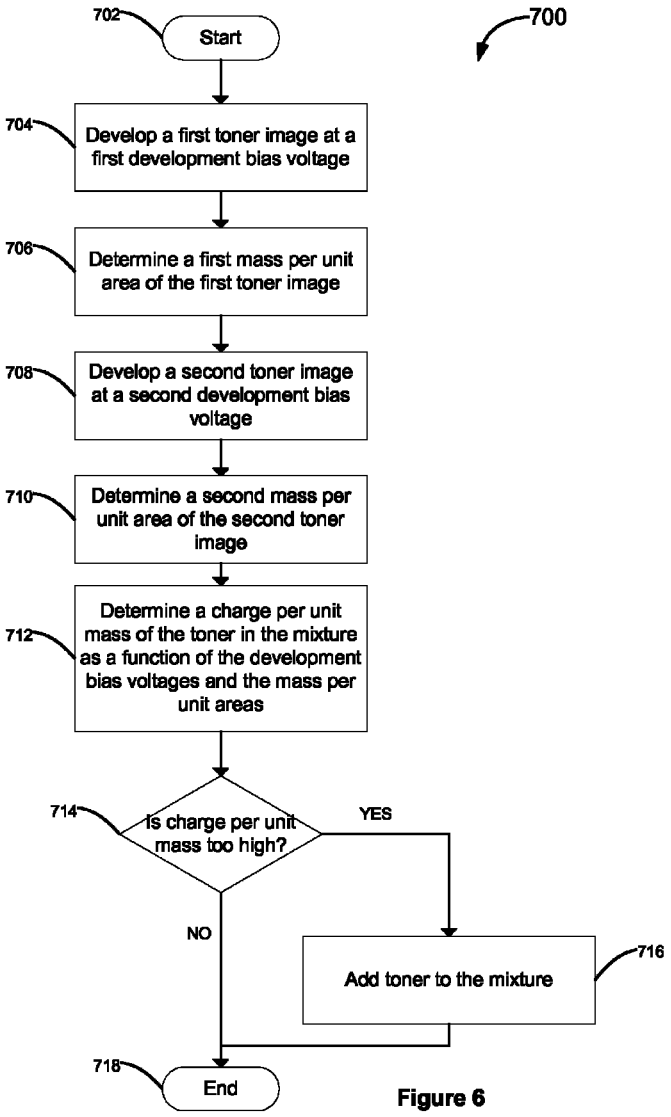
FIG. 6 is a flowchart of a method of controlling toner concentration in an image forming device according to one example embodiment.

FIG. 6 shows an example embodiment of a method 700 of controlling toner concentration in an image forming device according to one embodiment. Method 700 improves print quality by adjusting the ratio of toner to carrier in a mixture in a print engine. This ratio impacts the charge per unit mass of the toner which impacts the mass per unit area of toner images.

At block 704, controller 102 develops a first toner image at a first development bias voltage. For example, the first development bias voltage may be 100V. At block 706, controller 102 determines a first mass per unit area of the first toner image.

At block 708, controller 102 develops a second toner image at a second development bias voltage, the second development bias voltage is not equal to the first development bias voltage. For example, the second development bias voltage may be 200V. At block 710, controller 102 determines a second mass per unit area of the second toner image.

At block 712, controller 102 determines the charge per unit mass of the toner in the mixture. Equation 1, as described previously, relates charge per unit mass to development bias voltage. Thus, the charge per unit mass of the toner in the mixture may be determined as a. function of the development bias voltages and the mass per unit areas of the two toner images.

At block 714, a determination is made whether the charge per unit mass is too high, i.e., if the charge is higher than a predetermined threshold. If so, at block 716 controller 102 adds toner to the mixture.

Note that the steps of method 700 may be performed in alternative orders. For example, block 704 and block 708 may be performed before block 706 and block 710. In this example, the first toner image and the second toner image are developed and then the optical sensor measures the mass per unit area of the two images.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A method of operating an image forming device, the image forming device includes a mixture of toner and magnetic carrier, the method comprising:

developing a first toner image at a first development bias voltage;

determining a first mass per unit area of the first toner image;

developing a second toner image at a second development bias voltage, the second development bias voltage is not equal to the first development bias voltage;

determining a second mass per unit area of the second toner image; and adjusting a ratio of toner to magnetic carrier in the mixture as a function of the first development bias voltage, the second development bias voltage, the first mass per unit area, and the second mass per unit area.

2. The method of claim 1, further comprising:

determining a slope of a linear equation relating change in development bias voltage, between the first development bias voltage and the second development bias voltage, to change in mass per unit area, between the first mass per unit area and the second mass per unit area;

wherein the adjusting is as a function of the slope of the linear equation.

3. The method of claim 1, wherein the adjusting includes adding toner to the mixture.

4. A method of controlling toner concentration in an image forming device, the image forming device includes a mixture of toner and carrier, the method comprising:

developing a first toner image at a first development bias voltage;

determining a first mass per unit area of the first toner image;

developing a second toner image at a second development bias voltage, the second development bias voltage is not equal to the first development bias voltage;

determining a second mass per unit area of the second toner image;

determining a charge per unit mass of the toner in the mixture as a function of the first development bias voltage, the second development bias voltage, the first mass per unit area, and the second mass per unit area; and adding toner to the mixture if the charge per unit mass of the toner is higher than a predetermined threshold.

5. An image forming device comprising:

a photoconductor;

a magnetic roller;

a power supply coupled to the photoconductor and the magnetic roller, the power supply is configured to drive a development bias voltage between the photoconductor and the magnetic roller;

a mixture of toner and carrier positioned to be transported by the magnetic roller such that the toner is developed onto the photoconductor;

a toner feed mechanism positioned to add toner to the mixture;

an optical sensor configured to measure a mass per unit area of toner developed on the photoconductor; and a controller coupled to the power supply, the toner feed mechanism, and the optical sensor, the controller is configured to develop a plurality of toner images at different development bias voltages, measure the mass per unit area of the developed images, compute the slope of a linear equation relating change in development bias voltage to change in mass per unit area of the developed images, and add toner to the mixture if the computed slope deviates from a predetermined operating point.

6. The image forming device of claim 5, wherein the optical sensor is positioned to measure toner located on the photoconductor.

7. The image forming device of claim 5, further comprising an intermediate transfer mechanism positioned to receive the toner developed on the photoconductor; wherein the optical sensor is positioned to measure toner located on the intermediate transfer mechanism.

* * * * *